US006048056A

United States Patent [19]

Hotomi

[11] Patent Number: 6,048,056

[45] Date of Patent: Apr. 11, 2000

[54] INK CARTRIDGE

[75] Inventor: Hideo Hotomi, Nishinomiya, Japan

[73] Assignee: Minolta, Co., Ltd., Osaka, Japan

[21] Appl. No.: 09/189,604

[22] Filed: Nov. 10, 1998

[30] Foreign Application Priority Data

Nov. 25, 1997 [JP] Japan ..... 9-322959

[51] Int. Cl.[7] ..... B41J 2/175

[52] U.S. Cl. ..... 347/86

[58] Field of Search ..... 347/85, 86, 87

[56] References Cited

U.S. PATENT DOCUMENTS 4,178,595 12/1979 Jinnai et al. ..... 347/7

5,509,140 4/1996 Koitabashi et al. ..... 347/86

*Primary Examiner*—N. Le
*Assistant Examiner*—Michael Nghiem
*Attorney, Agent, or Firm*—Sidley & Austin

[57] ABSTRACT

An ink cartridge for an ink jet printing apparatus is disclosed. The ink cartridge includes an ink compartment and a filler compartment. The filler compartment has an absorbent filler and an ink expulsion outlet. The ink cartridge further includes a movable partition which largely separates the ink compartment from the filler compartment; however, the ink compartment freely supplies ink to the filler compartment for expulsion. The partition is biased toward the filler compartment to exert an even and continuous pressure against the filler. The applied pressure reduces waste and increases operational efficiencies and performance.

20 Claims, 5 Drawing Sheets

INK CARTRIDGE

FIELD OF THE INVENTION

The present invention pertains to an ink cartridge for an ink jet printing apparatus, and in particular, to an ink cartridge for an ink jet printing apparatus which efficiently utilizes ink stored therein.

BACKGROUND OF THE INVENTION

Conventional ink cartridges employed in ink jet printers generally have the construction shown in FIG. 10. The ink cartridge 110 has an ink compartment 112 that maintains an ink supply and an adjacent filler compartment 116 that houses an absorbent filler 114. A partition 120 separates the ink compartment 112 and the filler compartment 116 and defines an opening 118. The opening 118 allows fluid communication between the ink compartment 112 and the filler compartment 116. The filler compartment 116 includes an ink expulsion opening 122 for discharge of ink to an ink jet head, a rib 124 that presses against the filler 114, and an air vent opening 126 to allow air to enter the ink cartridge 110. The rib 124 and the air vent opening 126 are formed in the top wall of the filler compartment 116.

For the ink cartridge 110, ink stored in the ink compartment 112 sufficiently penetrates the filler 114 via the connecting opening 118. When the ink cartridge 110 is mounted upon a carriage fitting (not shown), a connecting terminal (not shown), which protrudes from the carriage fitting, extends through the ink expulsion opening 122 and into the filler 114. When this occurs, the ink contained in the filler 114 flows into a carriage guide path (not shown) via holes in a tip of the connecting terminal (not shown), whereupon the ink is supplied to a coupled ink jet head.

While the ink cartridge 110 exhibits little ink leakage when operatively positioned relative to a carriage and stably expels ink quantities during operation, use of the ink cartridge 110 commonly results in wasteful consumption of ink and, consequently, the ink cartridge 110. Specifically, the ink cartridge 110 is typically replaced when the ink compartment 112 is depleted; however, in this condition, the filler 114 continues to maintain a significant quantity of ink. Thus, discarding the ink cartridge 110 in this state results in wasteful consumption of ink and the ink cartridge 110.

Accordingly, a need exists for an ink cartridge that fully utilizes ink stored in a filler after depletion of an ink supply within an ink compartment.

SUMMARY OF THE INVENTION

The present invention is directed to an ink cartridge for use in an ink jet printing apparatus. The ink cartridge has a housing which includes an ink chamber, and a filler chamber. The filler chamber includes an absorbent filler and has an ink expulsion opening from which ink flows to a coupled ink jet print head or the like. As the filler chamber and the ink chamber are in fluid communication, the ink chamber supplies ink to the filler chamber and the filler therein. The ink cartridge further includes a movable partition which substantially separates the ink chamber from the filler chamber.

For each embodiment of the present invention, the ink cartridge includes a force-applying member which contacts at least the partition. The force-applying member biases the partition toward the filler compartment. Operationally, the partition applies a force to the filler within the filler compartment in inverse proportion to a level of ink within the ink cartridge.

The object of the present invention is to solve the problems outlined above by providing a simply constructed ink cartridge that, when used, does not entail wasteful consumption of the ink or of the ink cartridge.

DETAILED DESCRIPTION OF THE PREFERRED EMBODIMENTS

Figure 1:
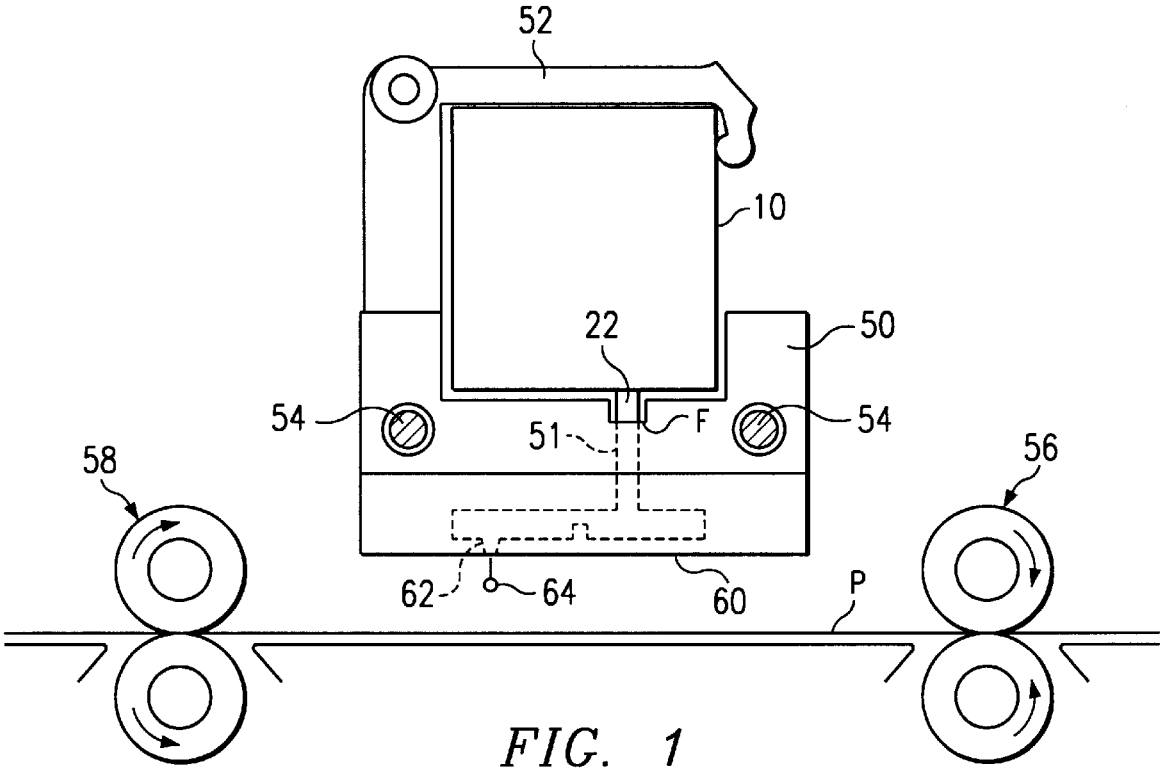
FIG. 1 is a side view showing an ink cartridge mounted to an ink jet printer.

Embodiments of the present invention will now be explained with reference to the accompanying drawings. FIG. 1 shows an ink cartridge 10 mounted to an ink jet printer. The ink cartridge 10 is mounted to a fitting F on a carriage 50 and is held in place by a cartridge holder 52. The carriage 50 is guided by guide shafts 54. The carriage 50 further scans the recording paper P conveyed by means of a paper feed roller 56 and a paper eject roller 58 that rotate in the directions indicated by the arrows.

An ink jet head 60 is mounted to a lower portion of the carriage 50. Ink expelled from an ink expulsion opening 22 of the ink cartridge 10 is supplied to the ink jet head 60 via an ink guide path 51 inside the carriage 50. The ink supplied to the ink jet head 60 is discharged in the form of ink drops 64 from a nozzle 62 in response to image information. The discharged ink drops 64 adhere to the recording paper P, thereby recording an image.

Figure 2:
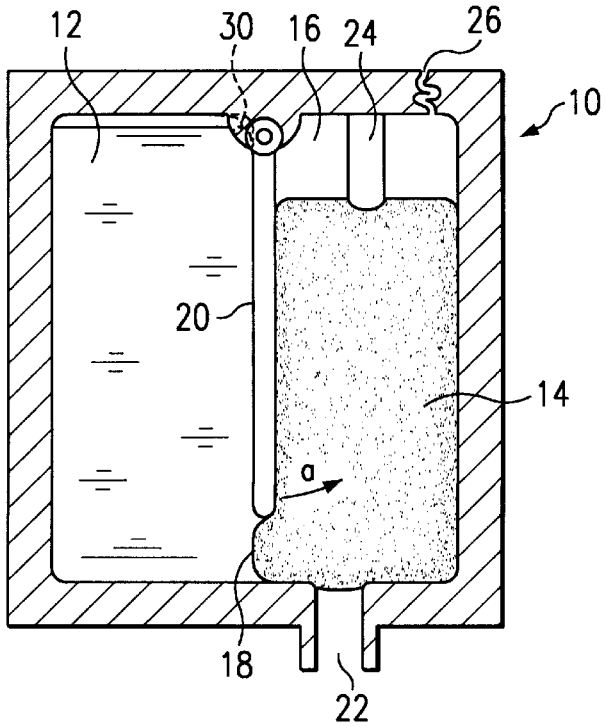
FIG. 2 is a cross-sectional view of an ink cartridge of a first embodiment of the present invention.
Figure 10:
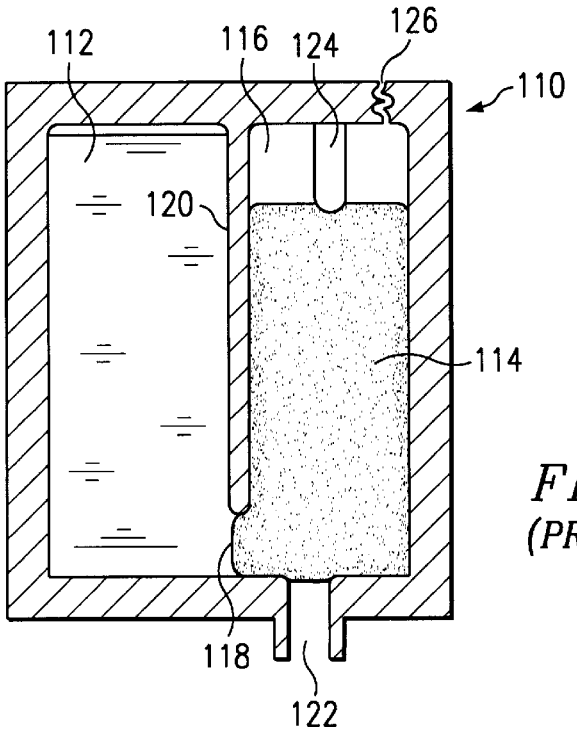
FIG. 10 (PRIOR ART)
FIG. 10 is a cross-sectional view of one example of a conventional ink cartridge.

The ink cartridge 10 of a first embodiment will now be explained with reference to FIG. 2. The ink cartridge 10 has a construction that is essentially identical to that of the ink cartridge 110 of FIG. 10. In other words, the ink cartridge 10 includes a box made of a resin, such as polyurethane. The ink cartridge 10 has an ink compartment 12 that maintains an ink supply and an adjacent filler compartment 16 that houses an absorbent filler 14. The absorbent filler 14 is formed from, for example, a urethane foam. A partition 20 separates the ink compartment 12 and the filler compartment 16 and defines an opening 18. The opening 18 allows fluid communication between the ink compartment 12 and the filler compartment 16. The filler compartment 16 includes an ink expulsion opening 22 for discharge of ink to an ink jet head, a rib 24 that presses against the filler 14, and an air vent opening 26 to allow air to enter the ink cartridge 10.

The rib 24 and the air vent opening 26 are formed in the top wall of the filler compartment 16.

Figure 3:
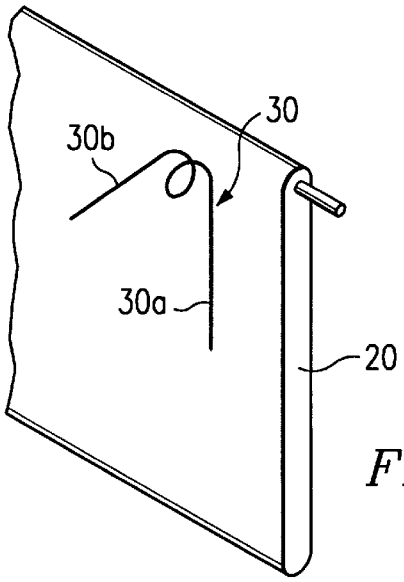
FIG. 3 is a perspective view showing a manner in which a torsion spring may be fixed to the partition of the ink cartridge of FIG. 2.

The construction of the ink cartridge 10 differs from that of the ink cartridge 110 in that the partition 20 is rotatably supported at its upper end. A force is applied to the partition 20 by means of a torsion spring (force-applying member) 30 in a direction consistent with direction a. The torsion spring 30 may be fixed at one end 30*a* to a surface of the partition 20 as shown in FIG. 3, or its other end 30*b* may be fixed to the top wall of the ink compartment 12, or both ends may be fixed in the manners described. In addition, there may be one or multiple torsion springs 30.

In an initial state (i.e., when the ink cartridge 10 is first mounted in the carriage 50), ink almost completely fills the ink compartment 12, and the ink then penetrates sufficiently to the top of the filler 14 via the connecting opening 18. In this condition, the force applied to the partition 20 by the torsion spring 30 is balanced by an opposing force exerted by a combination of the elastic force of the filler 14 and the liquid pressure from the ink that has penetrated the filler 14, thereby leaving the partition 20 aligned more or less vertically.

As ink is supplied to the ink jet head 60 from the ink cartridge 10, the ink level in the ink compartment 12 gradually falls. As this occurs, air within the ink cartridge 10 gradually increases, and the liquid pressure applied by the ink inside the filler 14 decreases accordingly. When this occurs, the balance with the torsion spring 30 is lost, and the partition 20 begins to move under the force of the torsion spring 30, thereby applying pressure to the filler 14.

As the amount of remaining ink declines, the partition 20 presses against the filler 14 bit by bit, and by the time the ink in the ink compartment 12 has been totally consumed, the ink in the filler 14 has been almost completely squeezed out by the partition 20 for expulsion. Therefore, using the ink cartridge 10, it is not necessary to replace the ink cartridge 10 due to ink flow cessation even though a sufficient amount of ink still remains in the ink cartridge and, in particular, in filler 14. Consequently, wasteful consumption of ink and ink cartridges can be avoided. In addition to this benefit, due to the gradual application of pressure against the filler 14 by the partition 20, ink is expelled from the ink cartridge 10 with uniform pressure until the ink is more completely expended.

The ink cartridges of the second through fifth embodiments of the present invention will now be explained with reference to FIGS. 4 through 7. The same parts used in connection with the ink cartridge 10 will be designated by the same numbers, and since each of the second through fifth embodiments has the same operation and effect as the first embodiment, explanation of said operation and effect will be omitted.

Figure 4:
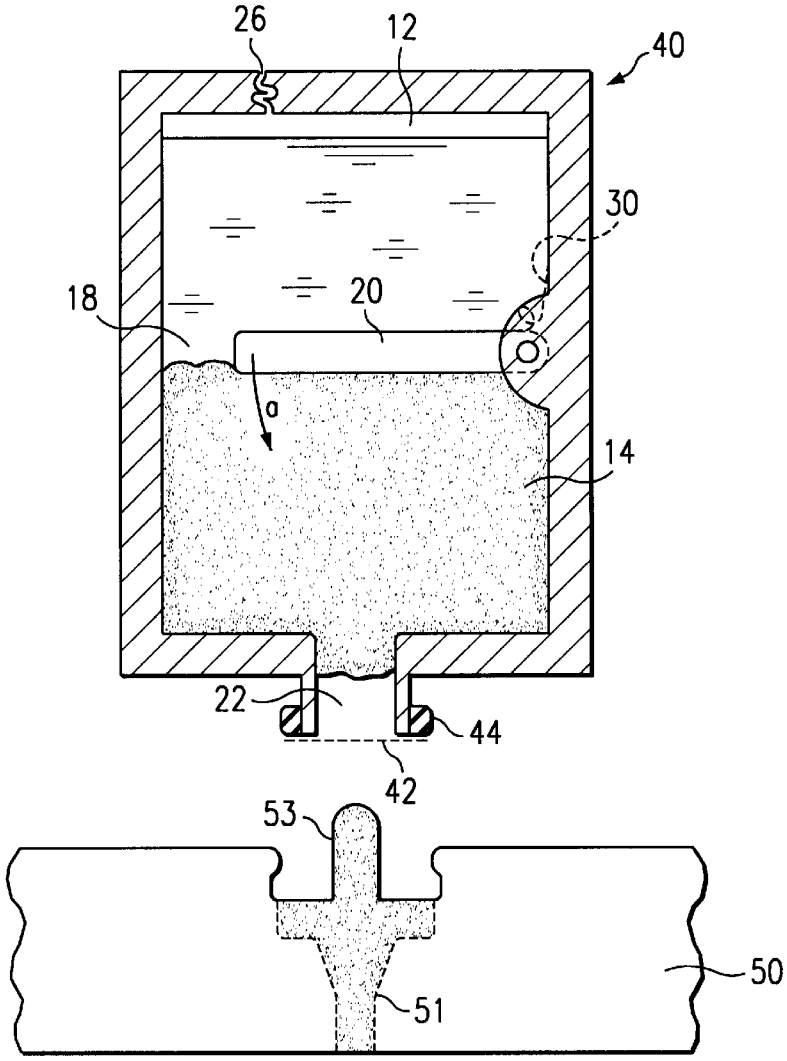
FIG. 4 is a cross-sectional view of an ink cartridge of a second embodiment of the present invention.

In the ink cartridge 40 of the second embodiment, the ink compartment 12 is located above the filler compartment 16 and the filler 14, which is oriented horizontally, as shown in FIG. 4. The ink cartridge 40 is illustrated with a seal membrane 42 and a packing member 44 located around the expulsion opening 22.

For mating the ink cartridge 40 with a carriage 50, a connecting terminal 53 that protrudes upward from a carriage 50 is located on a fitting of the carriage 50. The connecting terminal 53 and the ink guide path 51, which leads to the ink jet head 60, are formed as a single unit from porous alumina. When the ink cartridge 40 is pushed into the fitting of the carriage 50, the connecting terminal 53 breaks the seal membrane 42 and enters the ink expulsion opening 22. With the tip of the connecting terminal 53 extending into the filler 14, ink within the ink cartridge 40 is supplied from the filler 14 to the ink jet head 60 via the holes in the alumina of the connecting terminal 53 and the ink guide path 51.

Figure 5:
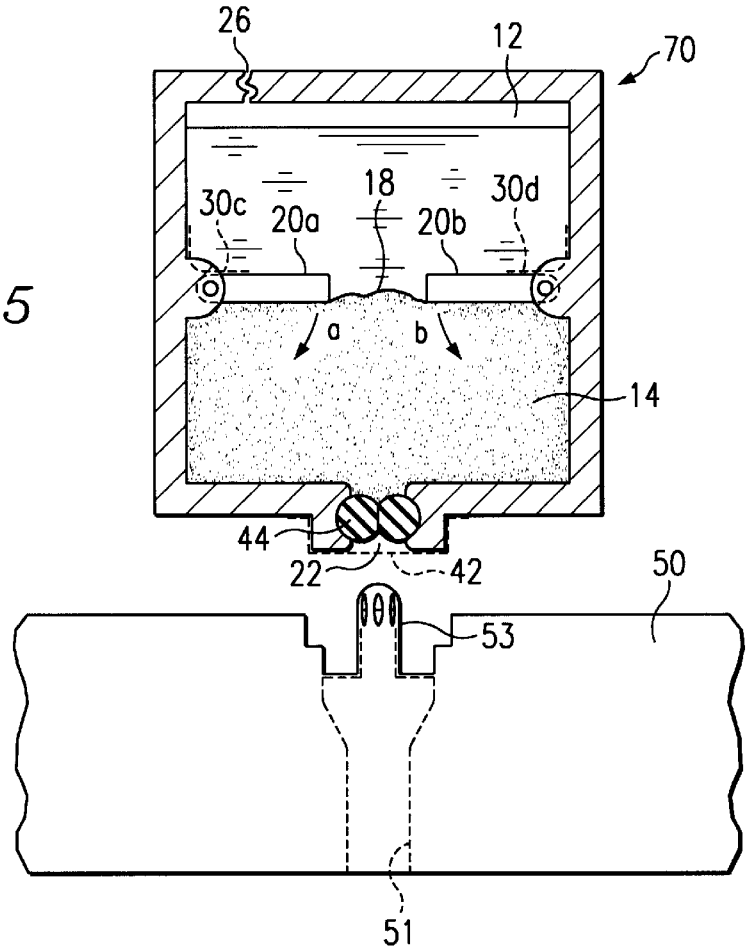
FIG. 5 is a cross-sectional view of an ink cartridge of a third embodiment of the present invention.

In reference to FIG. 5, the ink cartridge 70 of the third embodiment also has a horizontal configuration in which the ink compartment 12 is located above the filler 14. For this embodiment, two movable partitions 20*a* and 20*b* are located on opposing side walls of the ink cartridge 70. The partitions 20*a* and 20*b* are biased in the directions of arrows a and b by torsion springs 30*c* and 30*d*, respectively. A connecting opening 18 is formed between the partitions 20*a* and 20*b*. Illustrating another sealing means, the ink cartridge 70 has a ring packing member 44 at the ink expulsion opening 22 to effectively seal the ink expulsion opening 22. Moreover, the ink expulsion opening 22 is closed off by the seal membrane 42.

When the ink cartridge 70 is mounted onto the carriage 50, the connecting terminal 53 breaks the seal membrane 42, pierces the center of the ring packing member 44, and extends into the filler 14. When this occurs, the tip of the connecting terminal 53 extends into the filler 14, ink within the ink cartridge 70 is thereby supplied from the filler 14 to the ink jet head 60 via the holes in the tip of the connecting terminal 53 and the ink guide path 51.

Figure 6:
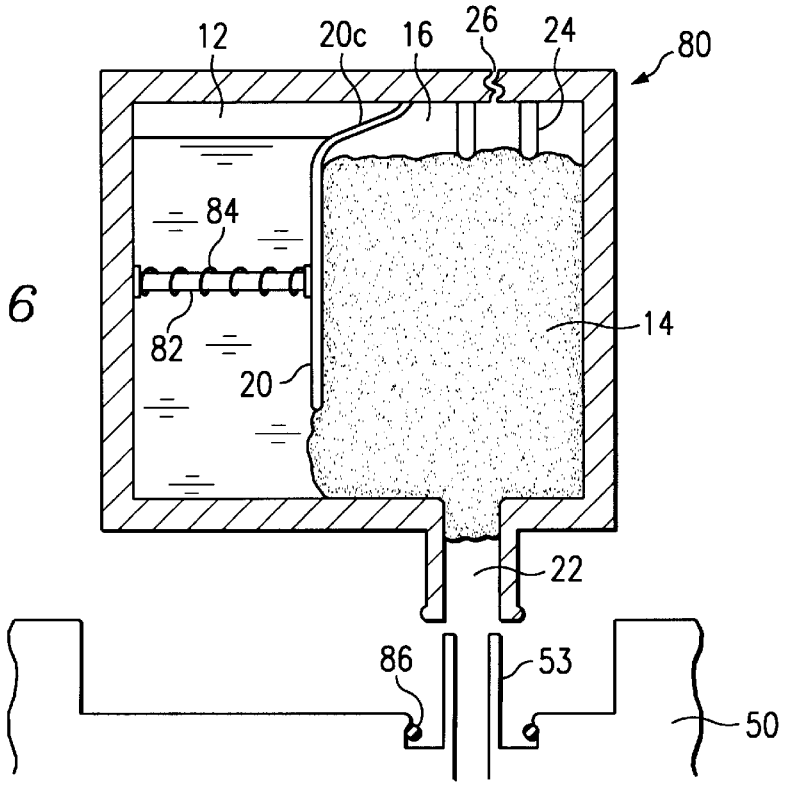
FIG. 6 is a cross-sectional view of an ink cartridge of a fourth embodiment of the present invention.

Referring to FIG. 6, the ink cartridge 80 of the fourth embodiment has the same vertical configuration as the ink cartridge 10 of the first embodiment, where the ink compartment 12 and the filler compartment 16 are located side by side. In this ink cartridge 80, the applied pressure mechanism is different from that employed in the previous embodiments. Specifically, the partition 20 is connected to the side wall of the ink compartment 12 by means of an expandable shaft 82, and a compressed coil spring 84 is located around the shaft 82 to bias the partition 20 away from the side wall of the ink compartment 12 to which the expandable shaft 82 is joined. The base 20*c* of the partition 20 is connected to the inner wall of the ink cartridge 80 and is flexible. Functionally, the partition 20 applies pressure to the filler 14 by means of the force of the coil spring 84.

When the ink cartridge 80 is mounted onto the carriage 50, the connecting terminal 53 extends through ink expulsion opening 22 and into the filler 14. To provide a seal, carriage 50 includes an o-ring 86 positioned around the connecting terminal 53. When the ink cartridge 80 is in an operative position, the o-ring 86 sealingly engages the expulsion opening 22. Ink is supplied from filler 14 to the ink jet head 60.

Figure 7:
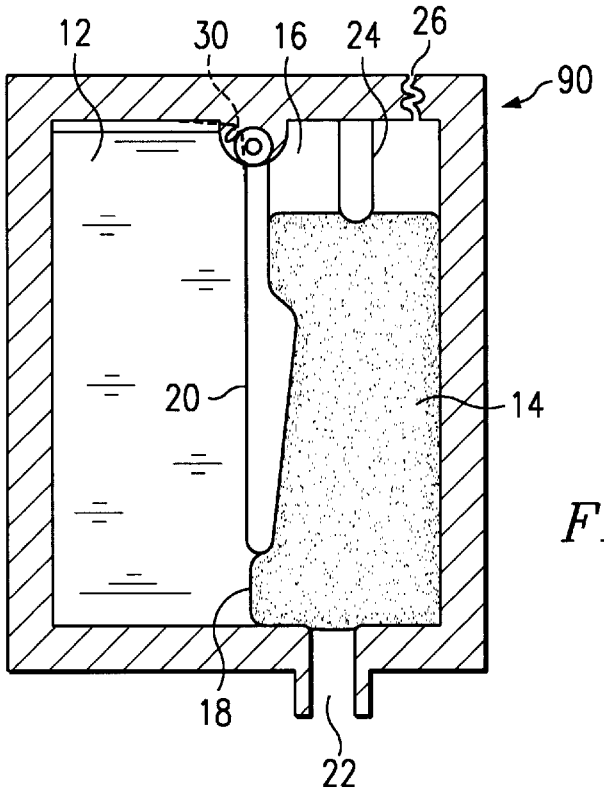
FIG. 7 is a cross-sectional view of an ink cartridge of a fifth embodiment of the present invention.

The ink cartridge 90 of the fifth embodiment is a variation of the ink cartridge 10 of the first embodiment in which the configuration of the partition 20 is changed, as shown in FIG. 7. The partition 20 of this embodiment is thinner at its ends and becomes gradually thicker in the middle. This configuration allows the partition 20 to press into the side of the filler 14 even where it is vertically oriented. The partition 20 of this embodiment provides more uniform pressure to be applied to the filler 14 and further increases the stability of the ink expulsion pressure.

Figure 8:
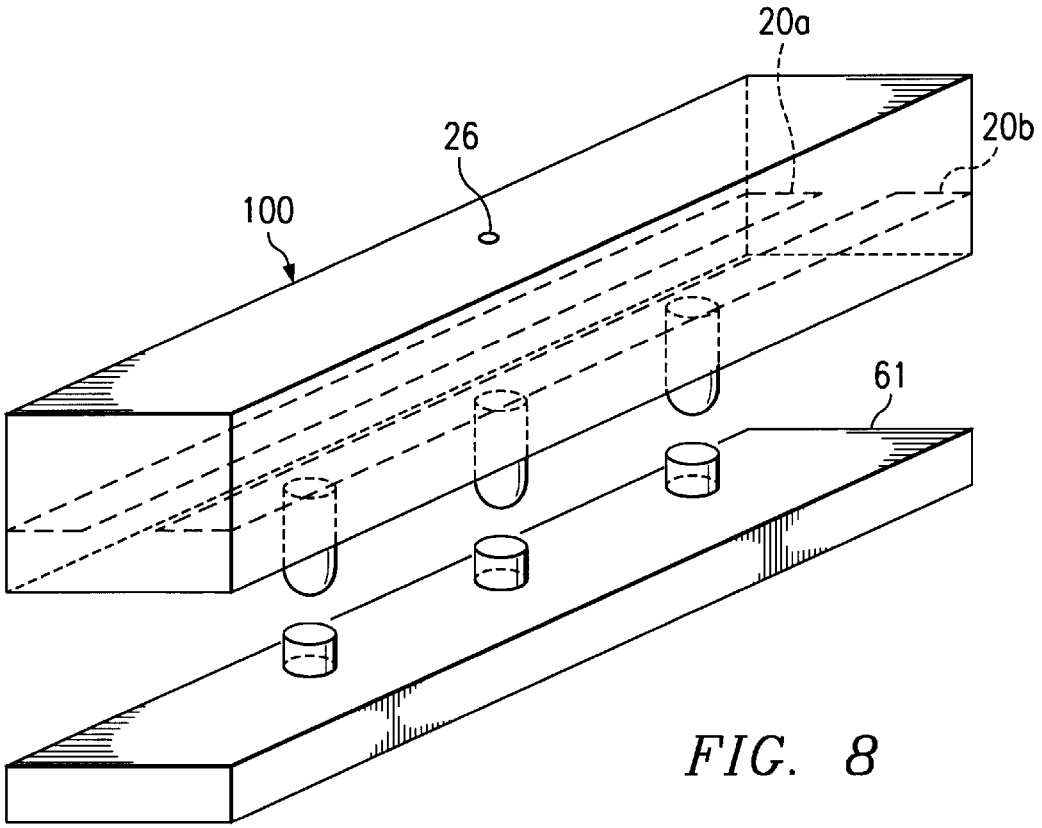
FIG. 8 is a perspective view showing the ink cartridge of the third embodiment formed so as to be compatible with a full-line type ink jet head.

The ink cartridge 100, shown in FIG. 8, is a variation of the ink cartridge 70 of the third embodiment. While the ink cartridge 100 has a physical construction similar to the ink cartridge 70, it is compatible with a full-line type ink jet head 61. With a full-line type ink jet head 61, it is not necessary to have the ink jet head scan across the entire width of the recording paper, and a carriage is unnecessary because the head has the length of the entire width of the recording paper. Therefore, in this case, the ink cartridge 100 is mounted directly onto the ink jet head 61.

Figure 9:
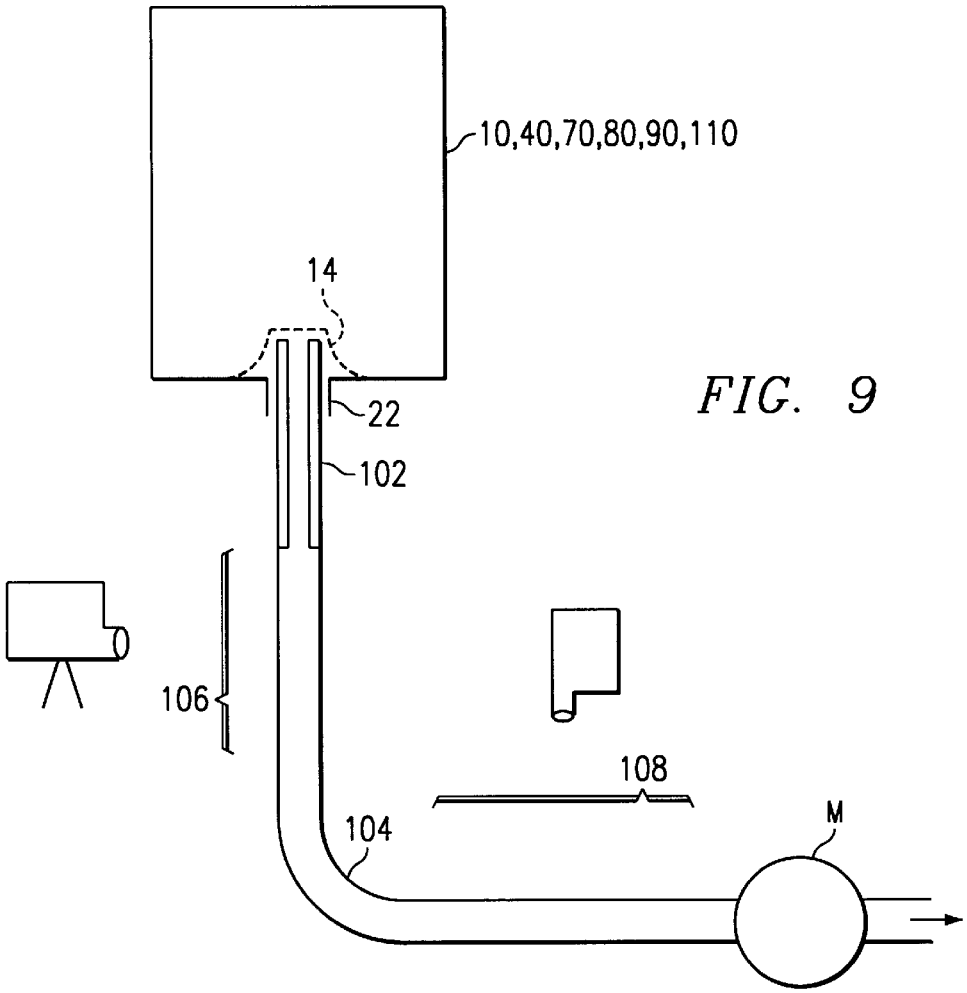
FIG. 9 illustrates an apparatus used in a comparison experiment.

The following discussion refers to experiments performed to compare the operational results of ink cartridges 10, 40, 70, 80 and 90 of the first through fifth embodiments, respectively, with those obtained with the conventional ink cartridge 110. These experiments were performed using the apparatus shown in FIG. 9. In this apparatus, the ink expulsion opening 22 of each ink cartridge was connected to a pressure-reducing device using an ink guide pipe 102 and an L-shaped transparent pipe 104. The pressure reducing device expels air from within transparent pipe 104 to reduce the air pressure within the transparent pipe 104.

In the first experiment, the ink in the ink cartridge was aspirated by applying a negative pressure of 0.95 atm by means of the motor M, and the ink expulsion results were measured. In this first experiment, black ink having the composition shown in Table 1 was used. In the second experiment, ink was aspirated from the ink cartridge using the same apparatus, video images of two straight segments 106 and 108 of the L-shaped pipe 104 were captured, and the number of air bubbles contained in the expelled ink was measured. Here, the ink used was transparent ink in which the dye was removed from the ink having the composition of Table 1.

TABLE 1

| Black Ink | | |
|---|---|---|
| | Composition | Ratio (wt %) |
| Solvent | Water | 78.6 |
| | Polyhydric alcohol/Diethylene glycol | 6.0 |
| | Polyhydric alcohol ether/Triethylene glycol monobutyl ether | 5.0 |
| | Thickening agent/Poly-ethylene glycol | 4.5 |
| Coloring Agent | Dye/Bayer BK-SP | 4.6 |
| Additive | Surfactant/Olfine E1010 | 0.8 |
| | pH Regulator/$NaHCO_3$ | 0.2 |
| | Fungicide Agent/Proxel XL-2 | 0.3 |

The ink cartridges were evaluated based on an amount of ink remaining in the ink cartridges after use, and the quantity of air bubbles in the expelled ink. In the first experiment, each ink cartridge had an internal volume of 10 cc (of which the ink compartment had an internal volume of 5 cc), and 5 cc of ink was infused into the ink cartridge. The following rankings were used for the amount of ink remaining in ink cartridges: essentially 0 g (State A); 1 g or less (State B); 1 g to 3 g (State C); and 3 g to 5 g (State D). For the second experiment, the following rankings were used to categorize the quantity of air within the expelled ink: no air bubbles (State A); three or fewer air bubbles (State B); three to five air bubbles (State C); and more than five air bubbles (State D).

The results of the first and second experiments are shown in Table 2 below:

TABLE 2

| Evaluation results | | | | | | |
|---|---|---|---|---|---|---|
| Cartridge | 10 | 40 | 70 | 80 | 90 | 110 |
| Ink expulsion | B | B | A | B | A | D |
| Air bubbles in ink | A | B | A | A | A | C |

As may be seen, while the ink cartridge 110 (control) had approximately 3 g of ink after use, the ink cartridges 10, 40, 70, 80, and 90 each retained 1 g or less of ink within the respective cartridges following use. For the second experiment, while the ink expelled from the ink cartridge 110 included three to five air bubbles mixed therein, there were no air bubbles present in the ink expelled from cartridges 10, 70, 80, and 90, and even in the ink cartridge 40, the number of air bubbles was reduced to three or fewer.

In particular reference to the results of the second experiment, the partition 20 of the ink cartridges 10, 40, 70, 80, and 90 of the present invention applies pressure to the ink filler 14 from the start, and thus when the ink guide pipe 102 is inserted into the respective ink cartridges, ink is expelled with great force, making it difficult for air to stay in the ink (at least initially). On the other hand, for the ink cartridge 110, this effect is absent; therefore, its expelling force is limited, and air that is initially present stays in the ink. For these reasons, in the second experiment, the number of air bubbles traveling down the pipe varied, and this can accordingly be interpreted as demonstrating that the present invention is more effective in stabilizing the ink expulsion from the ink jet head.

In the embodiments described above, a torsion spring or a coil spring was used as the force-applying means 30 to apply pressure to the partition 20, but the invention is not limited to these types of springs, and a plate spring or other type of spring member can be used. Alternatively, an elastic member made of rubber or some other substance may be used as the force-applying member 30 instead of a spring, or the construction may be such that the pressure is applied to the filler 14 by means of the elasticity of the resin partition itself.

As explained above, because the partition applies more pressure to the filler 14 as the amount of remaining ink falls, the ink can be almost entirely expelled from the expulsion opening 22 as if squeezed out from the filler 14, and wasteful consumption of the ink and ink cartridge can be avoided. In addition, because a special pressure member to apply pressure to the filler 14 is not needed (since a conventional partition is used to apply pressure to the filler in this construction), an ink cartridge may be provided that is compact and entails minimal additional cost.

While the invention has been described herein relative to a number of particularized embodiments, it is understood that modifications of, and alternatives to, these embodiments, such modifications and alternatives realizing the advantages and benefits of this invention, will be apparent to those of ordinary skill in the art having reference to this specification and its drawings. It is contemplated that such modifications and alternatives are within the scope of this invention as subsequently claimed herein, and it is intended that the scope of this invention claimed herein be limited only by the broadest interpretation of the appended claims to which the inventor is legally entitled.

What is claimed is:

1. An ink cartridge comprising:

an ink chamber which stores ink;

a filler chamber having an absorbent filler and an ink expulsion opening, wherein the filler chamber is in fluid communication with the ink chamber; and a movable partition which substantially separates the ink chamber from the filler chamber.

2. An ink cartridge in accordance with claim 1, further comprising a force-applying member in contact with at least the partition to bias the partition toward the filler chamber.

3. An ink cartridge in accordance with claim 2, wherein the force-applying member is a spring.

4. An ink cartridge in accordance with claim 1, wherein at least a portion of the partition is flexible.

5. An ink cartridge in accordance with claim 4, further comprising a force-applying member in contact with at least the partition to bias the partition toward the filler chamber.

6. An ink cartridge in accordance with claim 1, further comprising a second movable partition positioned opposite of the movable partition.

7. An ink cartridge in accordance with claim 1 wherein said ink cartridge is attachable to and detachable from an ink jet printing apparatus.

8. An ink cartridge comprising:

a housing defining an interior chamber;

at least one movable partition within the interior chamber which divides the interior chamber into an ink compartment and a filler compartment; and an ink expulsion opening which is in fluid communication with the filler compartment, wherein the ink compartment stores ink, and the filler compartment has an absorbent filler, wherein the ink compartment is in fluid communication with the filler compartment so that ink is freely supplied from the ink compartment to the filler compartment.

9. An ink cartridge in accordance with claim 8, further comprising a force-applying member in contact with at least the partition.

10. An ink cartridge in accordance with claim 9, wherein the force-applying member is a spring.

11. An ink cartridge in accordance with claim 9 wherein the force applying member is operatively connected to the partition so as to bias the partition toward the filler compartment.

12. An ink cartridge in accordance with claim 8, wherein at least a portion of the partition is flexible.

13. An ink cartridge in accordance with claim 12, further comprising a force-applying member in contact with at least the partition so as to bias the partition toward the filler chamber.

14. An ink cartridge in accordance with claim 8 wherein said ink cartridge is attachable to and detachable from an ink jet printing apparatus.

15. An ink cartridge comprising:

an ink chamber which stores ink;

a filler chamber having an absorbent filler and an ink expulsion opening, wherein the filler chamber is in fluid communication with the ink chamber; and a movable partition which substantially separates the ink chamber from the filler chamber and is movable in response to forces solely within the ink cartridge and not to forces exerted by an ink jet printing apparatus in which the ink cartridge is used.

16. An ink cartridge in accordance with claim 15, further comprising a force applying member acting between said ink cartridge and said partition to bias the partition toward the filler chamber.

17. An ink cartridge in accordance with claim 15 wherein the force applying member is a spring.

18. An ink cartridge in accordance with claim 15 wherein at least a portion of the partition is flexible.

19. An ink cartridge in accordance with claim 18, further comprising a force applying member in contact with at least the partition to bias the partition toward the filler chamber.

20. An ink cartridge in accordance with claim 15, further comprising a second movable partition positioned opposite of the movable partition.

* * * * *